US009290309B1

(12) United States Patent
Pabon

(10) Patent No.: US 9,290,309 B1
(45) Date of Patent: Mar. 22, 2016

(54) BEVERAGE BOTTLE AND ASSOCIATED METHOD

(71) Applicant: Kevin Pabon, Brooklyn, NY (US)

(72) Inventor: Kevin Pabon, Brooklyn, NY (US)

( * ) Notice: Subject to any disclaimer, the term of this patent is extended or adjusted under 35 U.S.C. 154(b) by 0 days.

(21) Appl. No.: 14/304,267

(22) Filed: Jun. 13, 2014

Related U.S. Application Data

(60) Provisional application No. 61/834,564, filed on Jun. 13, 2013.

(51) Int. Cl.
*B65D 51/28* (2006.01)
*A47G 19/22* (2006.01)
*B23P 19/00* (2006.01)

(52) U.S. Cl.
CPC ..... *B65D 51/2892* (2013.01); *A47G 19/2272* (2013.01); *B23P 19/00* (2013.01)

(58) Field of Classification Search
CPC ..... A47G 19/2272; A61J 1/2093; A61J 2001/2041; B01F 2215/0039; B23P 19/00; B65D 51/2892; B65D 81/3222; B65D 81/3227; B65D 81/3283; B65D 51/28
USPC ..... 206/219, 221, 222; 222/145.1, 145.5
See application file for complete search history.

(56) References Cited

U.S. PATENT DOCUMENTS

| | | | | |
|---|---|---|---|---|
| 5,035,320 | A * | 7/1991 | Plone | A47G 21/004 206/219 |
| 6,609,612 | B2 * | 8/2003 | Vlodek | 206/222 |
| 7,918,336 | B2 * | 4/2011 | Olsen et al. | 206/221 |
| 8,376,134 | B1 * | 2/2013 | Underwood | 206/221 |
| 8,453,833 | B2 * | 6/2013 | Porter | 206/222 |
| 8,453,834 | B2 * | 6/2013 | Porter | 206/222 |
| 2006/0226035 | A1 * | 10/2006 | Smith et al. | 206/219 |
| 2008/0202951 | A1 * | 8/2008 | Landolt et al. | 206/222 |

* cited by examiner

*Primary Examiner* — Bryon Gehman

(57) ABSTRACT

A beverage bottle includes a primary compartment to store an existing fluid therein, a pod in communication with the primary compartment, a cap in communication with the pod. Such a cap includes a nozzle in communication with the primary compartment. A primary travel path extends from the primary compartment to the nozzle. Upon receiving a first user input at the primary compartment, the fluid is caused to discharge upstream along the primary travel path while remaining isolated from an interior of the secondary compartments. The pod includes a plurality of secondary compartments adapted to store a plurality of existing additives therein, respectively. A plurality of secondary travel paths extend from the secondary compartments into the primary compartment. In this manner, upon receiving a second user input at the pod, the existing additives are caused to selectively discharge downstream along the secondary travel paths, respectively.

15 Claims, 7 Drawing Sheets

BEVERAGE BOTTLE AND ASSOCIATED METHOD

CROSS REFERENCE TO RELATED APPLICATIONS

This application claims the benefit of U.S. Provisional Application No. 61/834,564 filed Jun. 13, 2013, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

1. Technical Field

Exemplary embodiment(s) of the present disclosure relates to beverage bottles and, more particularly, to a beverage bottle including a fluid-containing compartment and a plurality of additive-containing compartments for releasing at least one flavored additive into the water and thereby modifying a flavor of the water.

2. Prior Art

Regularly drinking large amounts of water is important for the healthy development of everyone's physiology. If you are trying to keep your body functioning in the ideal physical manner, you need to regularly flush out toxins and dead elements with large doses of clean, clear water. This prevents them from building up inside the body, where they can occasion all manner of debilitating and disabling illness. Water is the fuel of life, so it makes sense that our bodies are primarily composed of it. It provides a chemically neutral matrix in which the general processes of life are well catalyzed, so it's no wonder that we're admonished to enjoy several liters of it every day. Devices that make water available on a regular basis are quite important for users in many fields these days, as more and more people adopt new drinking routines that provide a hoped-for improvement in general health and well-being.

While we all understand the massive health benefits accrued from regular water consumption, it can be tough, at times, to convince our bodies that such repeated consumption is in their best interests. Water is, to put it flatly, quite dull. The same chemical neutrality that makes it an ideal catalytic matrix for other processes tends to make it quite dull on the pallet. Water tastes boring, and as a result, many people find the have trouble convincing themselves to consume enough of it to maintain a healthy hydration level. It simply lacks the saccharine sweetness and delicious flavoring that fruit juices and other prepared drinks have trained our bodies to crave. As a result, it has become popular practice to accent water with the addition of various scent and flavor packages. These packages, whether delivered as a liquid concentrate or as a soluble powder, liven up the look, smell and taste of regular water, making it more appealing to the pallet. Water improvement additives offer an easy way to increase water consumption, for both children and adults. This type of assisted increased consumption provides all the additional benefits of consuming large quantities of water daily, while at the same time satisfying the user's desire for a novel and inspiring flavor.

Accordingly, a need remains for a beverage bottle in order to overcome at least one prior art shortcoming. The exemplary embodiment(s) satisfy such a need by providing a beverage bottle including a fluid containing compartment and a plurality of self-contained compartments that is convenient and easy to use, lightweight yet durable in design, versatile in its applications, and designed for releasing a flavored additive into the water and thereby modifying a flavor of the water.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a beverage bottle including a fluid containing compartment (primary compartment) and a plurality of self-contained compartments (secondary compartments) for releasing at least one flavored additive into the water and thereby modifying a flavor of the water. These and other objects, features, and advantages of the non-limiting exemplary embodiment(s) are provided by a beverage bottle including a primary compartment adapted to store an existing fluid therein, a pod in fluid communication with the primary compartment and located upstream therefrom, a cap in communication with the pod and located upstream therefrom. Such a cap includes a nozzle in fluid communication with the primary compartment. Advantageously, a primary travel path extending from the primary compartment to the nozzle. In this manner, upon receiving a first user input at the primary compartment, the fluid is caused to discharge upstream along the primary travel path while remaining isolated from an interior of the secondary compartments. Notably, the pod includes a plurality of secondary compartments adapted to store a plurality of existing additives therein, respectively. Beneficially, a plurality of secondary travel paths extend from the secondary compartments into the primary compartment. In this manner, upon receiving a second user input at the pod, the existing additives are caused to selectively discharge downstream along the secondary travel paths, respectively.

In a non-limiting exemplary embodiment, the nozzle includes a conduit fluidly isolated from the secondary compartments and registered along the primary travel path.

In a non-limiting exemplary embodiment, the pod further includes a central passageway registered along a central longitudinal axis of the pod. Such a conduit is selectively situated within the central passageway when the cap is attached and removed from the pod, respectively.

In a non-limiting exemplary embodiment, each of the secondary compartments are statically affixed to each other and anchored at a center of the pod such that the secondary compartments are equidistantly offset from the central longitudinal axis and disposed at mutually exclusive quadrants of the pod.

In a non-limiting exemplary embodiment, each of the secondary compartments includes an inlet formed at a top surface of the pod and spaced subjacent to the cap, an outlet formed at a bottom surface of the pod and seated within the primary compartment, a resilient diaphragm affixed to the inlet, and a valve located at the outlet. Advantageously, the additive is caused to egress the valve when the resilient diaphragm is compressed to a tensioned position.

In a non-limiting exemplary embodiment, inlet is axially aligned with the outlet.

In a non-limiting exemplary embodiment, the resilient diaphragm is detachably mated to the inlet.

In a non-limiting exemplary embodiment, the cap further includes: an aperture configured to receive the resilient diaphragm therethrough when the cap is engaged with the pod.

The present disclosure further includes a method of utilizing a beverage bottle. Such a method includes the steps of: providing a primary compartment adapted to store an existing fluid therein; providing and fluidly communicating a pod with the primary compartment, wherein the pod includes a plurality of secondary compartments; locating the pod upstream of the primary compartment; providing and communicating a cap with the pod; and locating the cap upstream of the pod, wherein the cap includes a nozzle in fluid communication with the primary compartment.

The method further includes the steps of: obtaining and storing a plurality of existing additives in the secondary compartments, respectively; providing a primary travel path extending from the primary compartment to the nozzle; providing a plurality of secondary travel paths extending from the secondary compartments into the primary compartment; wherein, upon receiving a first user input at the primary compartment, the fluid discharging upstream along the primary travel path while remaining isolated from an interior of the secondary compartments; and wherein, upon receiving a second user input at the pod, the existing additives selectively discharging downstream along the secondary travel paths, respectively.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
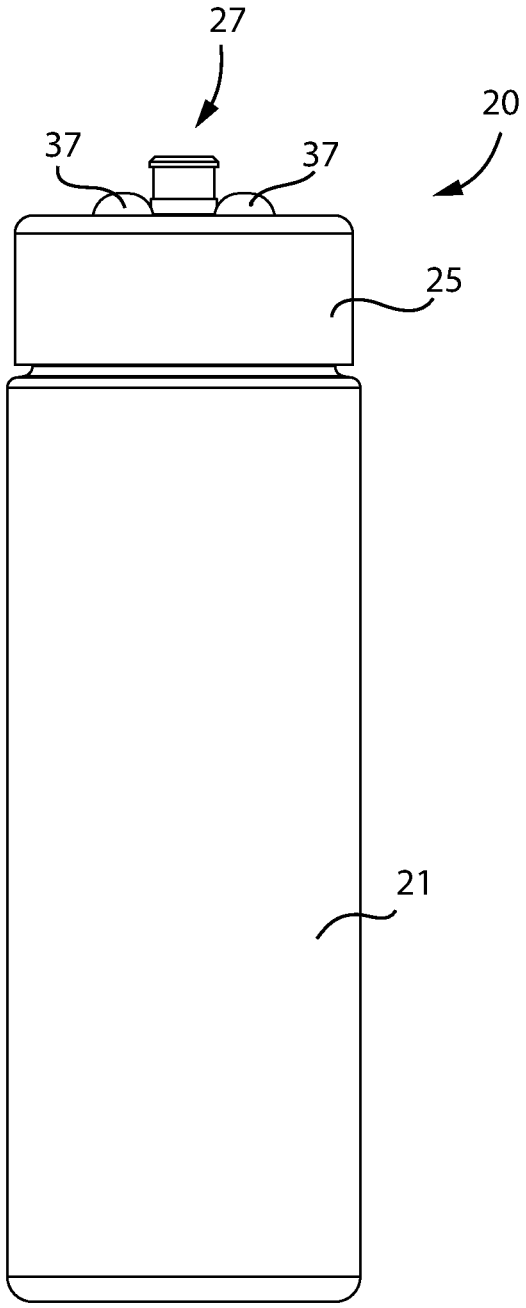
FIG. 1 is a side elevational view of a beverage bottle, in accordance with a non-limiting exemplary embodiment.
Figure 2:
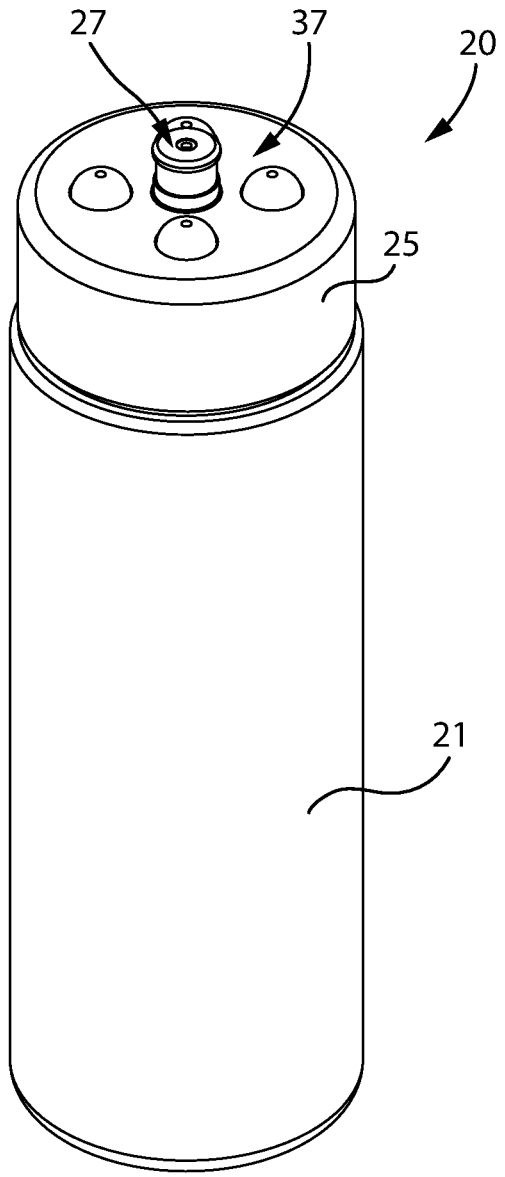
FIG. 2 is a perspective view of the beverage bottle illustrated in FIG. 1.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

The non-limiting exemplary embodiment(s) is/are referred to generally in FIGS. 1-11 and is/are intended to provide a beverage bottle 20 including a fluid-containing compartment (primary compartment 21) and a plurality of self-contained compartments (secondary compartments 22) for releasing a flavored additive 23 into water (fluid 24) and thereby modifying a flavor of the 24. It should be understood that the exemplary embodiment(s) may be used to mix many different types of flavor additives 23 with fluid 24 and should not be limited to any particular type of flavor additive 23 described herein.

Referring to FIGS. 1-11 in general, a beverage bottle 20 includes a fluid-containing compartment (primary compartment 21) and a plurality of self-contained compartments (secondary compartments 22) for releasing at least one flavored additive 23 into water (fluid 24) and thereby modifying a flavor of the fluid 24. These and other objects, features, and advantages of the non-limiting exemplary embodiment(s) are provided by a beverage bottle 20 including primary compartment 21 adapted to store an existing fluid 24 therein, a pod 26 in fluid communication with the primary compartment 21 and located upstream therefrom, a cap 25 in communication with the pod 26 and located upstream therefrom. Such a cap 25 includes a nozzle 27 in fluid communication with the primary compartment 21. Advantageously, a primary travel path 28 extends from the primary compartment 21 to the nozzle 27. In this manner, upon receiving a first user input (e.g., squeezing) at the primary compartment 21, the fluid 24 is caused to discharge upstream along the primary travel path 28 while remaining isolated from an interior of the secondary compartments 22. Notably, the pod 26 includes a plurality of secondary compartments 22 adapted to store a plurality of existing additives 23 therein, respectively. Beneficially, a plurality of secondary travel paths 29 extend from the secondary compartments 22 into the primary compartment 21. In this manner, upon receiving a second user input (e.g., pushing, squeezing, etc.) at the pod 26, the existing additives 23 are caused to selectively discharge downstream along the secondary travel paths 29, respectively.

It is noted that the use of "first user input" and "second user input" throughout the present disclosure is not intended to limit such user inputs to any particular chronological order. For example, the second user input preferably occurs before the first user input so that the additives 23 are discharged into the fluid 24, and thereafter mixed, prior to egresses the flavored fluid from nozzle 27. Furthermore, it is noted that while central passageway 32 is shown as channeling (via primary path 28) the flavored fluid towards nozzle 27, such a central passageway 32 is not critical. For example, slots 61 intermediately formed between adjacent secondary compartments 22 effectively channel flavored fluid towards nozzle 27 for consumption by the user. Such slots 61 may be linear and/or may be configured in other suitable shapes so long as flavored fluid is freely directed from primary compartment 21 towards nozzle 27. Also, while secondary compartments 22 are illustrated as anchored to each other proximate to central passageway 32, it is understood such secondary compartments 22 may be affixed to the top plate 62 of pod 26 and thereby spaced apart from each other (e.g., slots 61 are formed between adjacent secondary compartments 22). In this manner, the primary travel path 28 may be a plurality of paths located at slots 61 and not necessarily along central passageway 32.

In a non-limiting exemplary embodiment, the nozzle 27 includes a conduit 30 fluidly isolated from the secondary compartments 22 and registered along the primary travel path 28.

In a non-limiting exemplary embodiment, the pod 26 further includes a central passageway 32 registered along a central longitudinal axis 33 of the pod 26. The conduit 30 is selectively situated within the central passageway 32 when the cap 25 is attached and removed from the pod 26, respectively.

In a non-limiting exemplary embodiment, each of the secondary compartments 22 are statically affixed to each other and anchored at a center of the pod 26 such that the secondary compartments 22 are equidistantly offset from the central longitudinal axis 33 and disposed at mutually exclusive quadrants 34 of the pod 26.

In a non-limiting exemplary embodiment, each of the secondary compartments 22 includes an inlet 35 formed at a top surface of the pod 26 and spaced subjacent to the cap 25, an outlet 36 formed at a bottom surface of the pod 26 and seated within the primary compartment 21, a resilient diaphragm 37 affixed to the inlet 35, and a valve 38 located at the outlet 36. Advantageously, the additive 23 is caused to egress the valve 38 when the resilient diaphragm 37 is compressed to a tensioned position. It is noted that valve 38 may include a self-sealing membrane that prevents drips and spills, such as the valve sold under the name SIMPLISQUEEZE®. Of course, one skilled in the art understands other known valves may be employed without departing from the true scope and spirit of the disclosure.

In a non-limiting exemplary embodiment, inlet 35 is axially aligned with the outlet 36.

Figure 3:
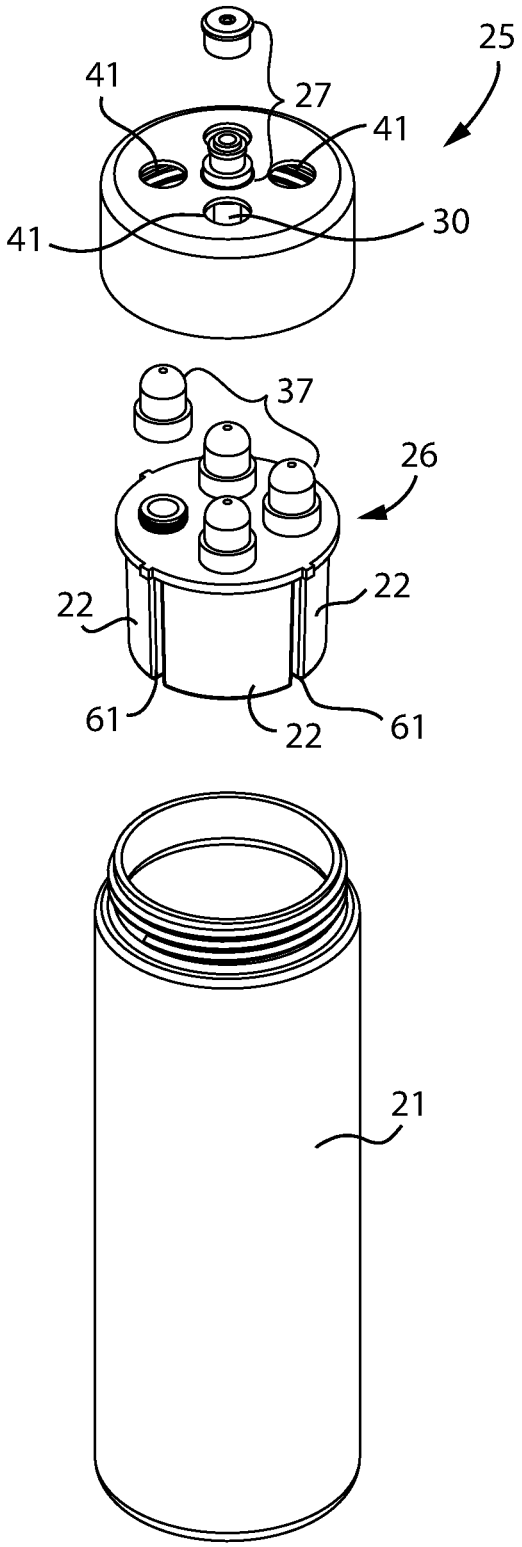
FIG. 3 is an exploded view of the beverage bottle showing the interrelationship between a cap, a pod with removable diaphragms (reusable embodiment) and a primary compartment.
Figure 4:
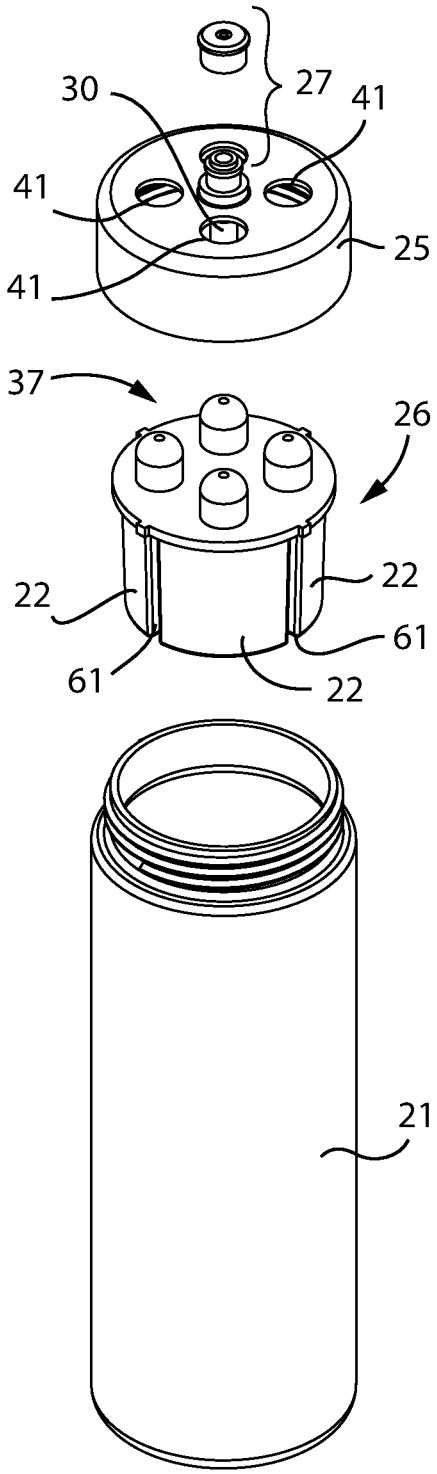
FIG. 4 is an exploded view of the beverage bottle wherein the diaphragms are permanently affixed to the pod (disposable embodiment)
Figure 6:
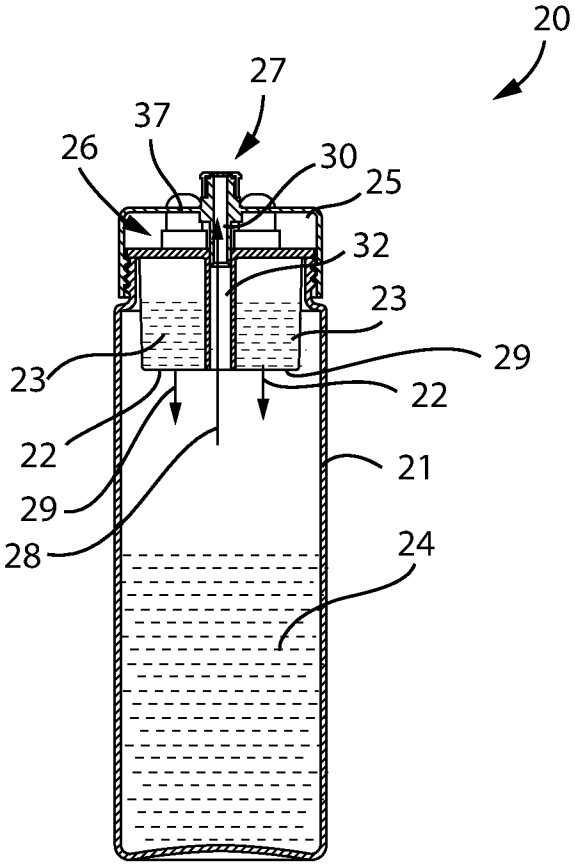
FIG. 6 is a cross-sectional view taken along line 6-6 in FIG. 5.
Figure 5:
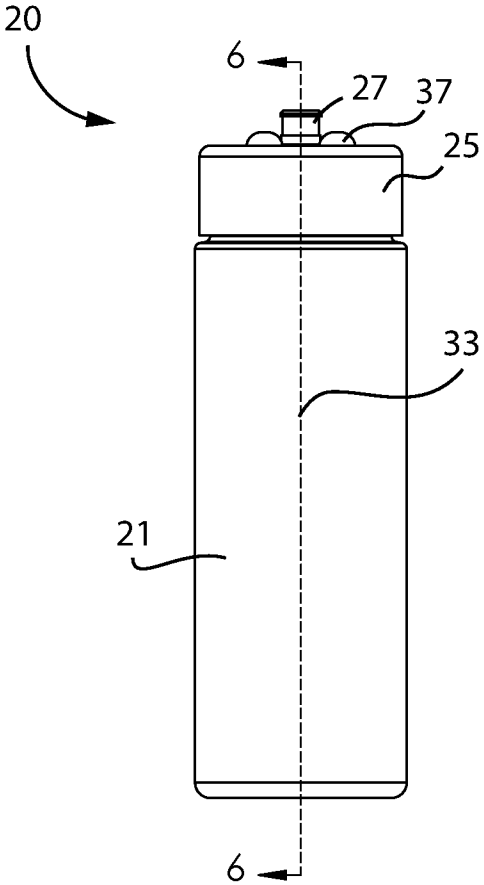
FIG. 5 is a side elevational view showing a cross-sectional line 6-6.
Figure 8:
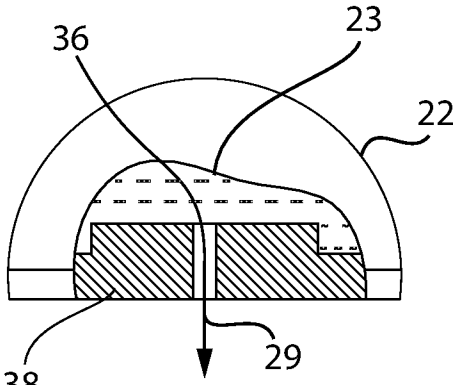
FIG. 8 is an enlarged break-away view of the valve shown at section 8 in FIG. 7.
Figure 7:
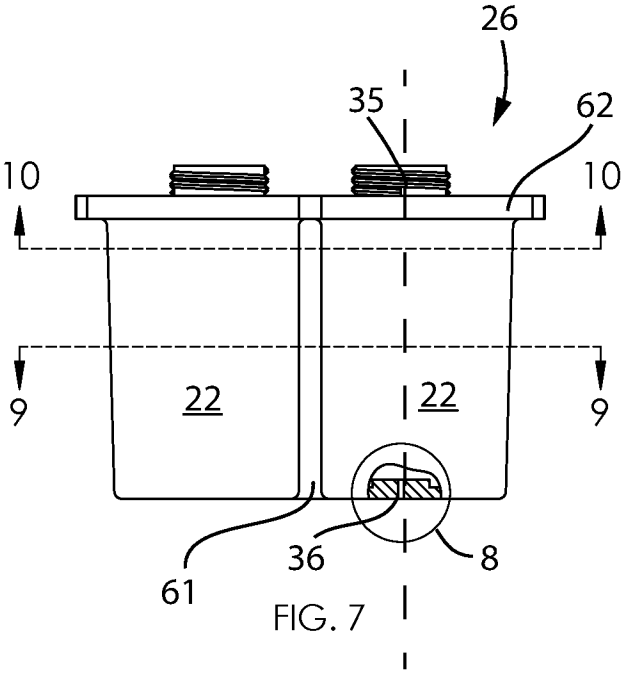
FIG. 7 is an enlarged side elevational view of the pod shown in FIG. 3.
Figure 11:
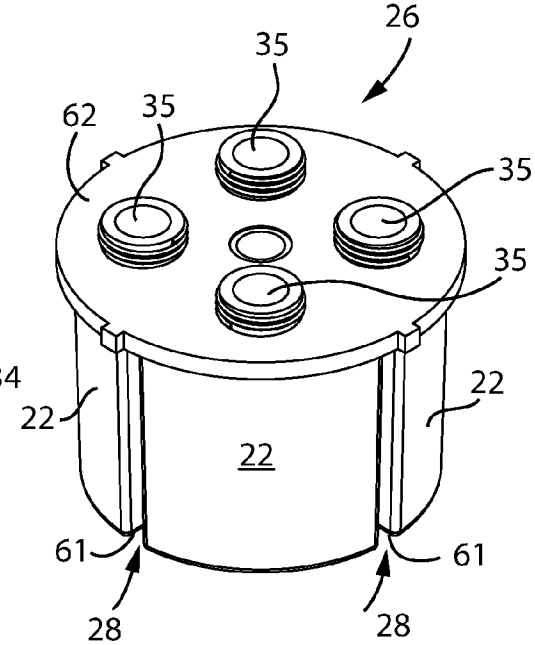
FIG. 11 is a perspective view of the pod shown in FIG. 3.
Figure 10:
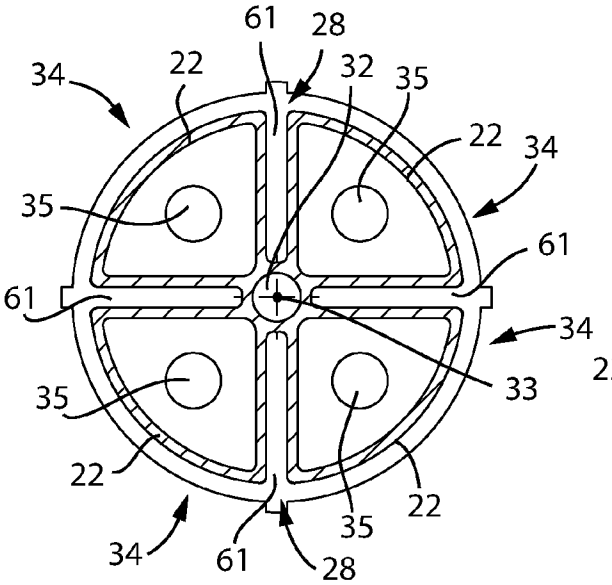
FIG. 10 is a cross-sectional view taken along line 10-10 in FIG. 7.
Figure 9:
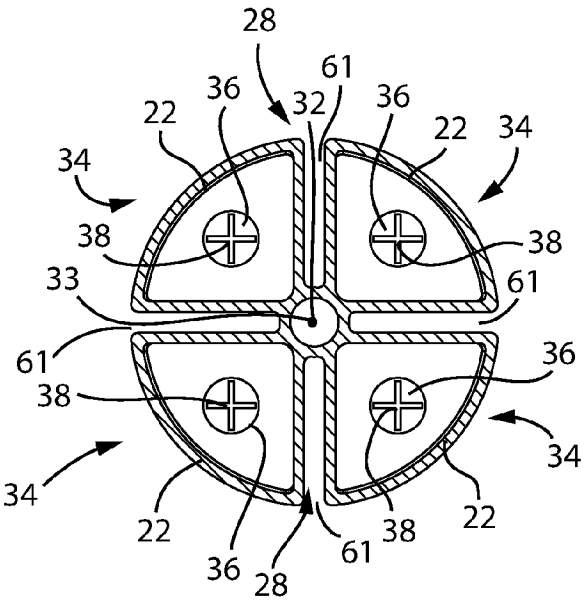
FIG. 9 is a cross-sectional view taken along line 9-9 in FIG. 7.

In a non-limiting exemplary embodiment, shown in FIG. 3, the resilient diaphragm 37 is detachably mated to the inlet 35 such that the pod 26 can be cleaned and reused. The embodiment shown in FIG. 4 is disposable wherein the diaphragms 37 are permanently affixed to the pod 26.

In a non-limiting exemplary embodiment, the cap 25 further includes aperture(s) 41 configured to receive the resilient diaphragm 37 therethrough when the cap 25 is engaged with the pod 26.

The present disclosure further includes a method of utilizing a beverage bottle 20. Such a method includes the steps of: providing a primary compartment 21 adapted to store an existing fluid 24 therein; providing and fluidly communicating a pod 26 with the primary compartment 21, wherein the pod 26 includes a plurality of secondary compartments 22; locating the pod 26 upstream of the primary compartment 21; providing and communicating a cap 25 with the pod 26; and locating the cap 25 upstream of the pod 26, wherein the cap 25 includes a nozzle 27 in fluid communication with the primary compartment 21.

The method further includes the steps of: obtaining and storing a plurality of existing additives 23 in the secondary compartments 22, respectively; providing a primary travel path 28 extending from the primary compartment 21 to the nozzle 27; providing a plurality of secondary travel paths 29 extending from the secondary compartments 22 into the primary compartment 21; wherein, upon receiving a first user input (e.g., squeezing) at the primary compartment 21, the fluid 24 discharging upstream along the primary travel path 28 while remaining isolated from an interior of the secondary compartments 22; and wherein, upon receiving a second user input (e.g., pushing, squeezing, etc.) at the pod 26, the existing additives 23 selectively discharging downstream along the secondary travel paths 29, respectively.

The beverage bottle 20 was designed specifically to improve the efficacy of using additives 23 to promote increased fluid 24 drinking Tired of having to purchase pre-flavored fluid 24 at increased prices when on extended sales trips, a user's pallet may grow to demand different flavors of fluid 24 at different times. Exemplary embodiments disclose a hydration-promoting portable fluid 24 bottle 20, with the capacity to store, dispense and utilize concentrated fluid 24 flavoring additives 23. By giving users a choice between multiple different flavors on tap, the beverage bottle 20 provides a level of choice that further empowers users and thereby encourages greater participation in re-hydration efforts.

In a non-limiting exemplary embodiment, the beverage bottle 20 may be composed of injection-molded food-grade plastic, to provide a safe vessel for all manner of potable liquids. The plastic may be cast into a cylinder with a two-and-one-half-inch diameter. It may be hollow, open at one end, and seven inches tall. At the open, top end it can flare in to a diameter of two-and-one-eighth-inches with a diagonal bevel, and is threaded to allow for the twist-on, twist-off application of the lid and secondary compartments 22 unit. The plastic body of the beverage bottle 20 can be cast in a wide variety of different colors and patterns, including custom-embossed logos or other emblems. The outer wall on the side of the bottle 20 is relatively flat and holds ink from a screen printing remarkably well, making the devices ideal for hosting display advertising and comprising part of a brand-building marketing give-away promotion.

In a non-limiting exemplary embodiment, the top of the beverage bottle 20 provides dual services to the user. First, it acts as a secure, impermeable lid, keeping any fluid 24, flavored or otherwise, securely constrained by the confines of the container body when not being used. This helps prevent the liquid from escaping and dampening its environment when it's being toted, and also to keep any external contaminants from being able to enter and despoil the drink. Secondly, the top provides a storage location for the secondary compartments 22 in which the user's multiple dosages of fluid additive 23 are stored. These secondary compartments 22 can be molded into a small pod 26 that secures effectively between the upper lid and the body of the beverage bottle 20. The secondary compartments 22 are arranged next to one another, each a semi-circular, hollow compartment with a small drop-dispensing nipple sculpted into the upper surface. Each secondary compartments 22 can be individually opened and re-sealed, by simply lifting off the removable panel that sports the dropper nipple, and then reconnecting it back into place (e.g., threaded connection, snap fit, etc.). The user can also use a disposable pod 26 where it could be replaced with a new full pod 26.

Using a beverage bottle 20 is a relatively simple affair. The user should start by selecting a beverage bottle 20 with a color and style that matches their own, personal look. This will help ensure that the device sees more use, as the user will feel comfortable wearing it out and about with them over the course of their regular workday. Once an appropriate beverage bottle 20 is selected, purchased and brought back to the user's home, it can be stocked up with the appropriate flavor enhancing mixtures.

In a non-limiting exemplary embodiment, the user may select multiple different fluid 24 experience boosters that they consider to be palatable and desirable. Quantities of each of these mixtures suitable to fill the secondary compartments 22 should be measured out. If using a powdered flavor additive 23, it should be dissolved in a little fluid 24, just enough to allow it to run freely. Once adequate amounts of the flavor additives 23 have been measured out, they can be placed in the multiple secondary compartments 22 and sealed inside by connecting the tops securely back into place.

In a non-limiting exemplary embodiment, flavor additives 23 are now ready for inclusion in any fluid 24 the user stores in the bottle 20. Enhancers can be added by simply pressing the desired dropper nipple (diaphragm) for the flavor selected and release a few drops into the drinking fluid 24 beneath. Once sufficient additive 23 has been added, and the entire beverage bottle 20 shaken to effectively mix the drinking fluid 24 and the flavor mixture together. The beverage is now ready for consumption, and the user retains enough flavoring additive 23 to upgrade a number of further drinks over the course of the next several days.

The beverage bottle 20 provides a significant advantage over other fluid bottles 20 currently on the market, in that it offers multiple large, refillable secondary compartments 22 in which excess flavoring additive 23 can be stored for later use. This convenience makes it easy for users to create appealing beverages that help with hydration where and when they want, without having to surrender to the costly impulse to buy pre-flavored fluid 24 from a convenience store. The beverage bottle 20 makes it simple for users to meet their personal hydration goals, without sacrificing their desire for a deliciously palatable beverage.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A beverage bottle, comprising:

a primary compartment adapted to store an existing fluid therein; and a pod in communication with said primary compartment and located upstream therefrom;

a cap in communication with said pod and located upstream therefrom;

wherein said cap includes a nozzle in fluid communication with said primary compartment;

wherein said pod includes a plurality of secondary compartments adapted to store a plurality of existing additives therein, respectively;

a primary travel path extending from said primary compartment to said nozzle; and a plurality of secondary travel paths extending from said secondary compartments into said primary compartment;

wherein, upon receiving a first user input at said primary compartment, the fluid is caused to discharge upstream along said primary travel path from said primary compartment to said nozzle;

wherein, upon receiving a second user input at said pod, the existing additives are caused to selectively discharge downstream along said secondary travel paths, respectively, from said secondary compartments into said primary compartment;

wherein said primary travel path is located exterior of said secondary compartments and is in fluid communication from said primary compartment to said nozzle;

wherein each of said secondary compartments comprises:

an inlet formed at a top surface of said pod and spaced subjacent to said cap;

an outlet formed at a bottom surface of said pod and seated within said primary compartment;

a resilient diaphragm affixed to said inlet; and a valve located at said outlet;

wherein the existing additives are caused to egress said valve when said resilient diaphragm is compressed to a tensioned position.

2. The beverage bottle of claim 1, wherein said nozzle comprises: a conduit fluidly isolated from said secondary compartments and registered along said primary travel path.

3. The beverage bottle of claim 2, wherein said pod further comprises: a central passageway registered along a central longitudinal axis of said pod; wherein said conduit is selectively situated within said central passageway when said cap is attached and removed from said pod, respectively.

4. The beverage bottle of claim 3, wherein each of said secondary compartments are statically affixed to each other and anchored at a center of said pod such that said secondary compartments are equidistantly offset from said central longitudinal axis and disposed at mutually exclusive quadrants of said pod.

5. The beverage bottle of claim 1, wherein said inlet is axially aligned with said outlet.

6. The beverage bottle of claim 1, wherein said resilient diaphragm is detachably mated to said inlet.

7. The beverage bottle of claim 1, wherein said cap further comprises: an aperture configured to receive said resilient diaphragm therethrough when said cap is engaged with said pod.

8. A beverage bottle, comprising:

a primary compartment adapted to store an existing fluid therein; and a pod in fluid communication with said primary compartment and located upstream therefrom;

a cap in communication with said pod and located upstream therefrom;

wherein said cap includes a nozzle in fluid communication with said primary compartment;

wherein said pod includes a plurality of secondary compartments adapted to store a plurality of existing additives therein, respectively;

a primary travel path extending from said primary compartment to said nozzle; and a plurality of secondary travel paths extending from said secondary compartments into said primary compartment;

wherein, upon receiving a first user input at said primary compartment, the fluid is caused to discharge upstream along said primary travel path, from said primary compartment to said nozzle, while remaining isolated from an interior of said secondary compartments;

wherein, upon receiving a second user input at said pod, the existing additives are caused to selectively discharge downstream along said secondary travel paths, respectively, from said secondary compartments into said primary compartment;

wherein said primary travel path is located exterior of said secondary compartments and is in fluid communication from said primary compartment to said nozzle;

wherein each of said secondary compartments comprises:

an inlet formed at a top surface of said pod and spaced subjacent to said cap;

an outlet formed at a bottom surface of said pod and seated within said primary compartment;

a resilient diaphragm affixed to said inlet; and a valve located at said outlet;

wherein the existing additives are caused to egress said valve when said resilient diaphragm is compressed to a tensioned position.

9. The beverage bottle of claim 8, wherein said nozzle comprises: a conduit fluidly isolated from said secondary compartments and registered along said primary travel path.

10. The beverage bottle of claim 9, wherein said pod further comprises: a central passageway registered along a central longitudinal axis of said pod; wherein said conduit is selectively situated within said central passageway when said cap is attached and removed from said pod, respectively.

11. The beverage bottle of claim 10, wherein each of said secondary compartments are statically affixed to each other and anchored at a center of said pod such that said secondary compartments are equidistantly offset from said central longitudinal axis and disposed at mutually exclusive quadrants of said pod.

12. The beverage bottle of claim 8, wherein said inlet is axially aligned with said outlet.

13. The beverage bottle of claim 8, wherein said resilient diaphragm is detachably mated to said inlet.

14. The beverage bottle of claim 8, wherein said cap further comprises: an aperture configured to receive said resilient diaphragm therethrough when said cap is engaged with said pod.

15. A method of utilizing a beverage bottle, said method comprising the steps of:

providing a primary compartment adapted to store an existing fluid therein; and providing and fluidly communicating a pod with said primary compartment, wherein said pod includes a plurality of secondary compartments;

locating said pod upstream of said primary compartment;

providing and communicating a cap with said pod;

locating said cap upstream of said pod, wherein said cap includes a nozzle in fluid communication with said primary compartment;

obtaining and storing a plurality of existing additives in said secondary compartments, respectively;

providing a primary travel path extending from said primary compartment to said nozzle;

providing a plurality of secondary travel paths extending from said secondary compartments into said primary compartment;

wherein, upon receiving a first user input at said primary compartment, the fluid discharging upstream along said primary travel path, from said primary compartment to said nozzle, while remaining isolated from an interior of said secondary compartments;

wherein, upon receiving a second user input at said pod, the existing additives selectively discharging downstream along said secondary travel paths, respectively, from said secondary compartments into said primary compartment;

wherein said primary travel path is located exterior of said secondary compartments and is in fluid communication from said primary compartment to said nozzle;

wherein each of said secondary compartments comprises:

an inlet formed at a top surface of said pod and spaced subjacent to said cap;

an outlet formed at a bottom surface of said pod and seated within said primary compartment;

a resilient diaphragm affixed to said inlet; and a valve located at said outlet;

wherein the existing additives are caused to egress said valve when said resilient diaphragm is compressed to a tensioned position.

* * * * *